US008181812B2

(12) United States Patent
Christenson

(10) Patent No.: US 8,181,812 B2
(45) Date of Patent: May 22, 2012

(54) MULTI SECTIONAL BUCKET

(76) Inventor: Joel Christenson, Fort Lauderdale, FL (US)

( * ) Notice: Subject to any disclaimer, the term of this patent is extended or adjusted under 35 U.S.C. 154(b) by 615 days.

(21) Appl. No.: 12/338,266

(22) Filed: Dec. 18, 2008

(65) Prior Publication Data

US 2009/0134169 A1 May 28, 2009

Related U.S. Application Data

(60) Provisional application No. 61/132,826, filed on Jun. 23, 2008, provisional application No. 61/127,205, filed on May 9, 2008.

(51) Int. Cl.
*B65D 25/04* (2006.01)
*B65D 85/00* (2006.01)

(52) U.S. Cl. ..... 220/533; 220/529; 220/532

(58) Field of Classification Search ..... 220/529, 220/532, 533

See application file for complete search history.

(56) References Cited

U.S. PATENT DOCUMENTS

| | | | | |
|---|---|---|---|---|
| 4,161,799 | A | 7/1979 | Sorrells | |
| 4,333,188 | A * | 6/1982 | Jensen et al. | 4/514 |
| 4,798,307 | A | 1/1989 | Evrard | |
| 6,976,286 | B1 * | 12/2005 | Sanabria | 15/264 |
| 7,083,064 | B2 * | 8/2006 | Zorzo | 220/529 |
| 7,318,247 | B2 | 1/2008 | Libman et al. | |
| 2002/0096525 | A1 * | 7/2002 | Bertoldo et al. | 220/544 |

* cited by examiner

*Primary Examiner* — Anthony Stashick
*Assistant Examiner* — Madison L Wright
(74) *Attorney, Agent, or Firm* — Daniel S. Polley, P.A.

(57) ABSTRACT

A bucket having three or more sections for separating wash liquid. Dividers create the sections and are placed in an up position when filling the bucket so that the water will flow throughout the entire bucket. The dividers can then slide back down to create the separated sections of clean liquid. The dividers can be connected to each other by means of horizontal bars attached on the top of the dividers which run along the sides of the bucket along the inside. Lifting the horizontal bar up will lift all of the attached dividers up simultaneously. The horizontal bars can be provided in two sections that can be connected to each other. When the two sections are disconnected, when one lifts one bar section, only the attached dividers will lift up simultaneously, while the other bar section and its attached divider will remain in its down position.

17 Claims, 6 Drawing Sheets

MULTI SECTIONAL BUCKET

This application claims priority to and the benefit of U.S. Patent Application Ser. No. 61/127,205, filed on May 9, 2008 and U.S. Patent Application Ser. No. 61/132,826, filed Jun. 23, 2008, both applications are incorporated by reference in their entireties.

BACKGROUND OF THE INVENTION

It should be understood in the discussion that follow that references to uncontaminated cleaning liquid means liquid which in the course of use will become contaminated to some degree. It should also be understood that the cleaning liquid referred to in this disclosure is frequently water combined with a chemical cleaning agent. However, such is not considered limiting and the cleaning liquid maybe water, detergent, or a combination of any chemical cleaning agent and water. Also the term water will mean water mixed with detergent or just water.

It typically takes approximately three to five sections of clean liquid in a bucket to properly clean the floors in a house and even more than five sections for commercial buildings or large homes. Water in the mop bucket turns dirty right after the first section of a floor is mopped because the used mop is submerged in the bucket after each section of a floor is mopped. When the user of a mop cleans the first section of the floor they then stick the dirty mop in the bucket of clean water which then contaminates the water. The water gets dirtier and dirtier as each section of a floor is mopped. Thus, what is considered cleaning a floor is in reality merely spreading dirty water around on the floor.

Furthermore, certain mops require the use of a wringer. A wringer sits on top of the bucket at the back part of the bucket. It is used to squeeze the excess water out of the mop after the mop is submerged in the bucket of water. The excess water is squeezed out prior to the user mopping a section of the floor. Typically after the user of a mop that requires the use of a wringer, mops a section of a floor they will submerge the now dirty mop in the bucket of water which contaminates the water. Then they will pull the mop out of the bucket and squeeze the excess dirty water from the mop through the wringer. The wringer, which sits on top of the bucket, allows the dirty water from the mop to be squeezed right back in the bucket of water. Each time the user submerges the mop in the bucket the water gets dirtier and dirtier and this dirty water is used to mop further sections of the floor. There are mop buckets out there that have a separate section to hold the excess water from a wringer. The problem with that type of mop bucket is that once the user of a mop cleans a section of the floor, the user then sticks the now dirty mop in the bucket of water which then turns the water dirty. The user then lifts the mop out of the dirty water and puts the mop through the wringer. As such, that section in the bucket that holds the water from the mop also has dirty water. So both sections in the bucket have dirty water immediately after mopping the first section of a floor. The user then uses dirty water to mop further sections of the floor and continues to contaminate the water every time they submerge the dirty mop in the dirty water.

There is a mop bucket on the market with two sections. One is to hold dirty water and the other to hold clean water. The problem with that is for the reasons mentioned earlier. Once someone mops the first section of a floor the dirty mop gets submerged in one of the sections of the bucket which turns the water dirty. If the user continues to submerge the mop in the dirty water after mopping the second section of the floor they will pull the mop out of the dirty water and contaminate the clean section of the bucket when they submerge the mop in the clean water. The clean section of the bucket will quickly get contaminated and get more and more contaminated as each section of the floor is mopped. If the user never uses the clean section of the bucket they might as well have a one section bucket and if they use the clean section it will quickly get contaminated.

The present invention is designed to overcome all of the above problems.

BRIEF SUMMARY OF THE INVENTION

The present invention provides a multi-sectional bucket having several divided/separate sections for clean liquid so the user can have a clean section of liquid in the bucket for each time they submerge the mop in the bucket. The bucket design is also good for people who clean bathroom sinks, window sills, and other surfaces in their house because they want a clean section of liquid in the bucket each time they submerge the rag their using to wash their house.

By providing multiple physically isolated sections of clean liquid, a much more sanitary and efficient way of cleaning is achieved with the present invention bucket. Partitions can be used to divide the sections in the bucket and can be constructed to slide up and down on tracks located on the internal wall of the bucket's body member so that the user does not have to stand and fill each section in the bucket separately with water. Rather, the user can just slide the partitions partially up and let the water run throughout the entire bucket. Once the level of water is reached in the bucket that the user feels comfortable with, the user can slide the dividers down and have several sections of clean liquid all isolated from each other section. Also when the user finishes mopping the floor or cleaning the user can lift the partitions partially up and pour out the dirty water through a pour out spout disposed at a top area of the bucket's body member and preferably at the front of the bucket (all the water from each section will be able to be emptied through the pour out spout when the dividers are lifted up).

The amount of water the user puts in the bucket does not have to reach the top of the bucket since there only needs to be a sufficient amount of liquid in each section in the bucket to comfortably submerge the mop, sponge, rag, etc. that is being used. This will keep the overall weight of the bucket down.

The tracks in the bucket that the dividers slide up and down on can be part of the internal walls of the bucket's body member (i.e. monolithically formed together, constructed integral, etc.) and can be made out of the same material as the body member. In addition to its sidewall, the body member will have a bottom portion and can also be provided with a top edge. A portion of the top edge can have a lip.

As opposed to tracks protruding outward from the internal sidewall of the body member, grooves formed in the sidewall or guiding mechanisms for the dividers can also be used and are also considered within the scope of the invention. So the user of the bucket does not have to lift each divider up individually when filling the bucket with water, one or more horizontal bars can be attached to the top of the dividers. The horizontal bars will allow the user to lift the horizontal bars up and have all the dividers go up simultaneously. Though not considered limiting, the horizontal bars can be made of the same material as the dividers and be formed as part of the dividers (i.e. monolithically formed, constructed integral therewith, etc.).

Gaskets, washers or other sealing mechanisms can be employed between the tracks/grooves and the dividers to help create a sealed relationship to prevent water from one section entering another section. Additionally, the size of the dividers in connection with the size of the track or groove opening which receives the dividers can be selected such that the insertion of the dividers into the tracks or grooves creates a self-sealing relationship without the necessity of any additional sealing mechanism (i.e. gasket, washer, etc.).

Thus, the present invention multi-sectional bucket eliminates all of the above-identified current problems and the time and hassle it takes to change the water every time the water gets dirty. Given the number of available mops that use a wringer, the present invention bucket can also accommodate a wringer. In this wringer accommodating embodiment, one of the divided sections in the bucket needs to be set apart for the wringer and excess water from the mop. Mops that use a wringer often take a lot of the water out of the bucket after the mop is submerged in the bucket. To avoid having to slide the wringer over each section in the bucket to hold the water from the mop, an end section in the bucket can be designated for holding all the water that comes from the mop. This end or last section in the bucket can hold the wringer and any excess water from the mop. Given the amount of excess water that will come from the mop from use with the wringer, it is preferred, though not considered limiting, to have the designated end or last be empty to maximize the amount of volume space for receipt of the excess water. Since the user of a bucket fills the bucket with water prior to mopping a floor, one of the dividers in my bucket needs to be in the down position so no water gets in the section when the user fills the bucket with water. Thus, movement of this divider, if permitted to move, is preferably independent of the other dividers.

To accomplish this goal, the horizontal bars that are connected to the top of the dividers can be provided in two sections. The horizontal bars which are in two pieces will be connected to each other by means of a standard clasp or hook or other conventional connection mechanism. When the first section of the horizontal bar is disconnected from the second section of the horizontal bar associated with the dividers to be moved, by the user lifting the second section up, all of the dividers associated with the second section will lift up simultaneously. However, the divider associated with the disconnected or detached first section of the horizontal bar will remain in its down position isolated from the other sections. This will allow the user to fill the bucket with water but with the one divider remaining down, the one isolated or separated section will not get any water. This one section in the bucket will be where the wringer will sit and will hold the excess water from the mop when the wringer is used. In commercial mop buckets this section in the bucket can be larger than the other sections in the bucket (residential mops take a lot less water out of each section in the bucket when the mop is submerged in the bucket).

As an alternative to the dividers secured to the horizontal bars or in lieu of, individual dividers can also be provided so that the user can determine the number of separated sections (customize) for the bucket. Where the dividers are permanently secured to the horizontal bars, this section customization ability is not possible and the bucket is restricted to the number of sections created by the secured dividers. Thus, it is within the scope of the invention to provide individual dividers and horizontal bar secured dividers with the bucket and allow the user to select which dividers to use. It is also within the scope of the invention to make the dividers removably secured to the horizontal bars, such as by snapping or screwing in, which will then allow the same dividers to be used individually or with the horizontal bars. For the individual dividers, handles or a tactile gripping surface can be provided to make gripping and pulling of the dividers easier. Lastly, for further customization of the bucket additional tracks or grooves can be provided along the sidewall, to allow the user to decide the where to insert the individual dividers, which can increase the number of possible sections for the bucket, increase or decrease the size of each section, permit sections of differing sized for the bucket, etc.

Another type of mop currently on the market is a sponge mop, which typically has a handle on a mop pole and when the handle, or lever, is pulled it causes rollers to squeeze the excess water out of the sponge. The sponge is located at the end of the mop pole. Since there is little excess water on the mop when this type of mop is submerged in the bucket and pulled out of the bucket the user does not need a separate section in the bucket to hold excess water or a place to put a wringer. The excess water from this type of mop can be put back into the section of the bucket the user submerged the mop into. The user can then use the next section of clean liquid in the bucket for the next section of the floor that is being mopped.

A residential mop bucket version of the invention can have three to approximately seven sections for clean liquid and a commercial bucket version, which is generally on wheels, can have approximately five to twelve sections and up. However, these preferred number of bucket sections are not considered limiting, and all versions of the invention (i.e. residential, commercial, wringer type, sponge type, etc.) can provided with any number of a reasonable amount (i.e. in view of bucket size restrictions) of sections, as long as the bucket has at least three sections.

Though not considered limiting, each section in the bucket can be approximately or about 4½ inches long in order to accommodate current mop sizes. Other measurements and dimensions can be selected and all are considered within the scope of the invention. Furthermore, the use of the term "residential bucket" and "commercial bucket" are used in a generic sense and not in any limiting sense and are basically used to differentiate between buckets which generally have wheels and buckets which generally do not have wheels.

Accordingly, it is the object of the present invention to provide several sections for clean liquid in one bucket. Proper sanitary mopping of a floor requires the mop to be submerged in clean uncontaminated liquid prior to mopping each section of a floor.

It is also another object of the present invention to allow the bucket to be filled with liquid without having to spent time separately filling each section with water.

It is another object of the invention to eliminate the necessity of emptying the bucket and refilling it each and every time the liquid in the bucket gets contaminated.

DETAILED DESCRIPTION OF THE INVENTION

Figure 1:
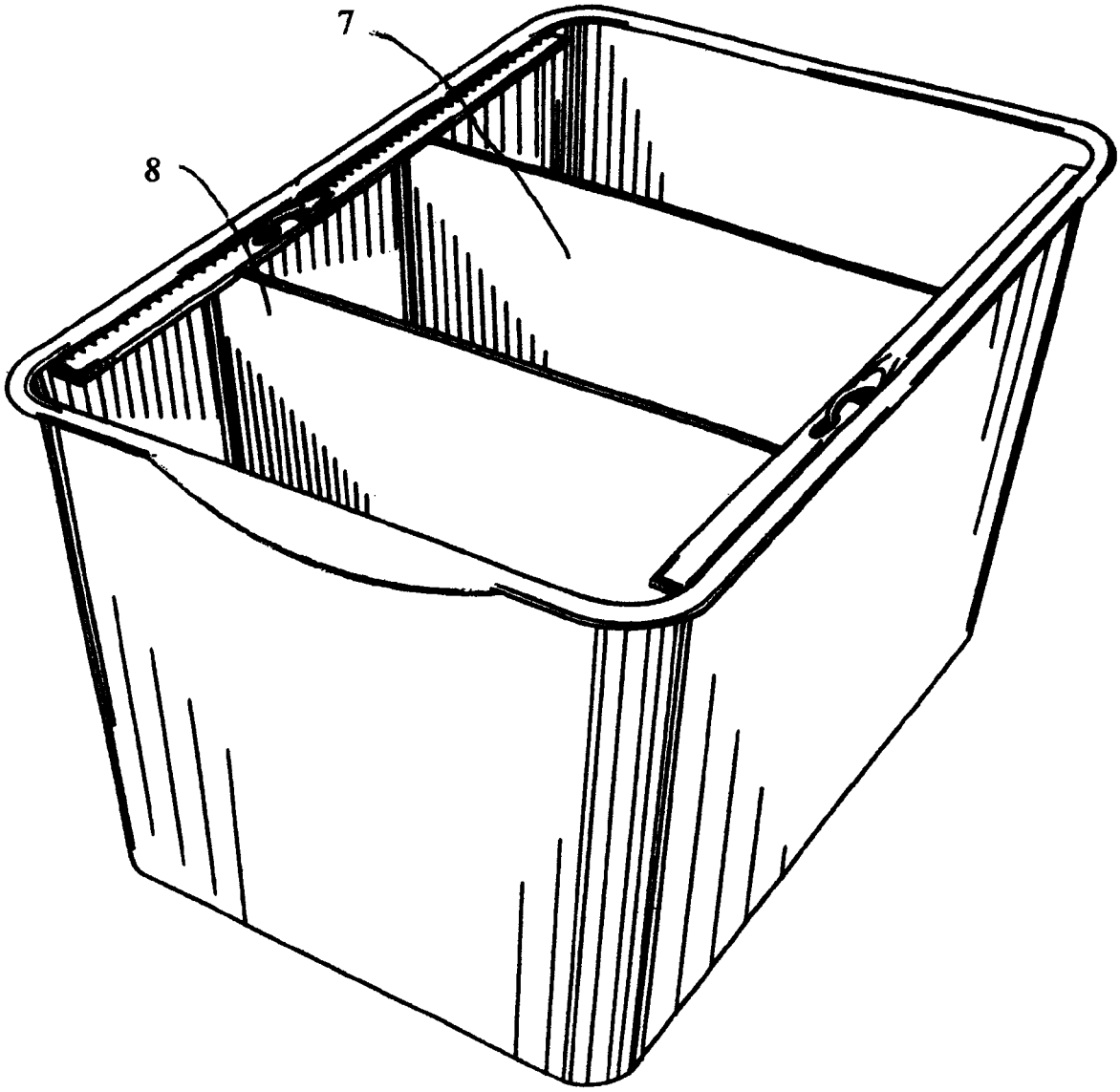
FIG. 1 is a top view of the bucket showing the partitions inside the bucket, with only three sections in this particular drawing.

The above Summary section of the invention provides a detailed description of this invention and is incorporated by reference into this section. Furthermore, FIG. 1 illustrates two vertical partitions or dividers 7 and 8, which when properly in place create the three sections inside the bucket. It is expected that a standard residential mop bucket will need approximately two to five partitions and for large areas like commercial buildings five to ten or even more sections may be needed. However, the invention is not limited to any particular number of sections. The dividers and bucket can be constructed from the same type of material, such as, but not limited, plastic, or can be constructed from different materials. The dividers may be constructed more rigid as compared to the rigidity of the body member of the bucket. The bucket has a body member having a sidewall and bottom, which together define the fluid or liquid storage area that is divided into separate sections by the dividers or partitions.

Figure 2:
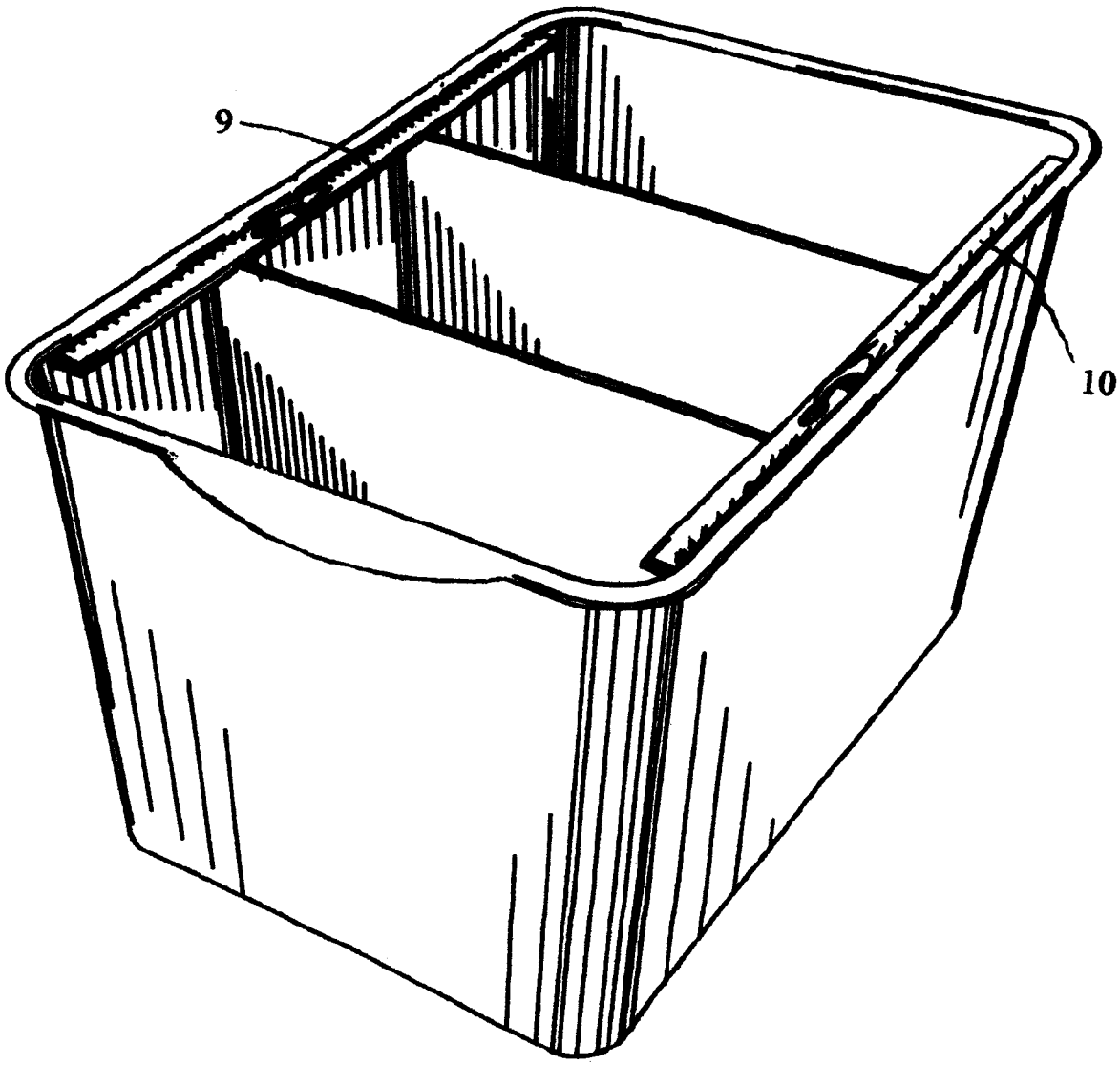
FIG. 2 is a top view of the bucket showing the horizontal bars that sit on top of the vertical dividers so that when the horizontal bars are lifted all the vertical dividers lift up simultaneously as well.

FIG. 2 illustrates the top view of the bucket with the horizontal bars 9 and 10 running along the inside of the bucket on both sides. The horizontal bar connects all the partitions together so that lifting the horizontal bars lifts all the partitions simultaneously. The horizontal bars are preferably attached to or formed as a top part of the dividers, particularly where the bars are made from the same mold that makes the dividers.

Figure 3:
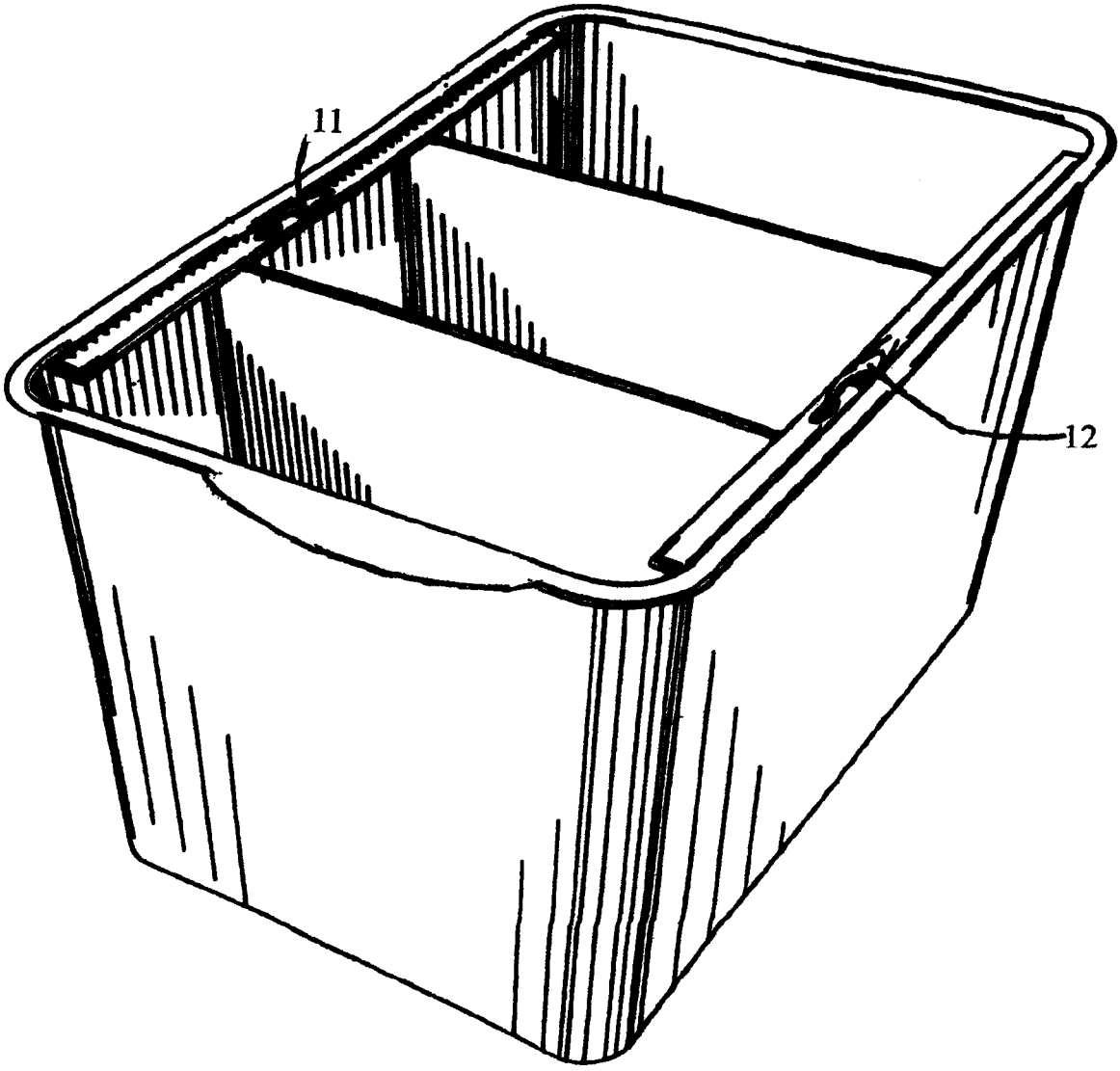
FIG. 3 is a side view of the standard type hook that can unhook and disconnect the horizontal bar from the remaining part of the horizontal bar.

FIG. 3 illustrates shows that there is a hook like or other connector device 11 and 12 on each horizontal bar. In one embodiment, each horizontal bar is two separate pieces that are kept together with the hook or other connecting device. The hook when unhooked, permit's the user when lifting the horizontal bars up, to lift all the verticals dividers attached to the second sections of the horizontal bars to go up except for the first section of the horizontal bar that was disconnected and the divider attached to it. The user can fill the bucket with water and the water will be able to travel through the entire bucket accept for the one section that has the divider down and remains fluidly isolated or fluidly separated from the remain fluid storage area of the bucket. The wringer sits on top of the bucket that has no liquid (i.e. above the isolated section).

Figure 4:
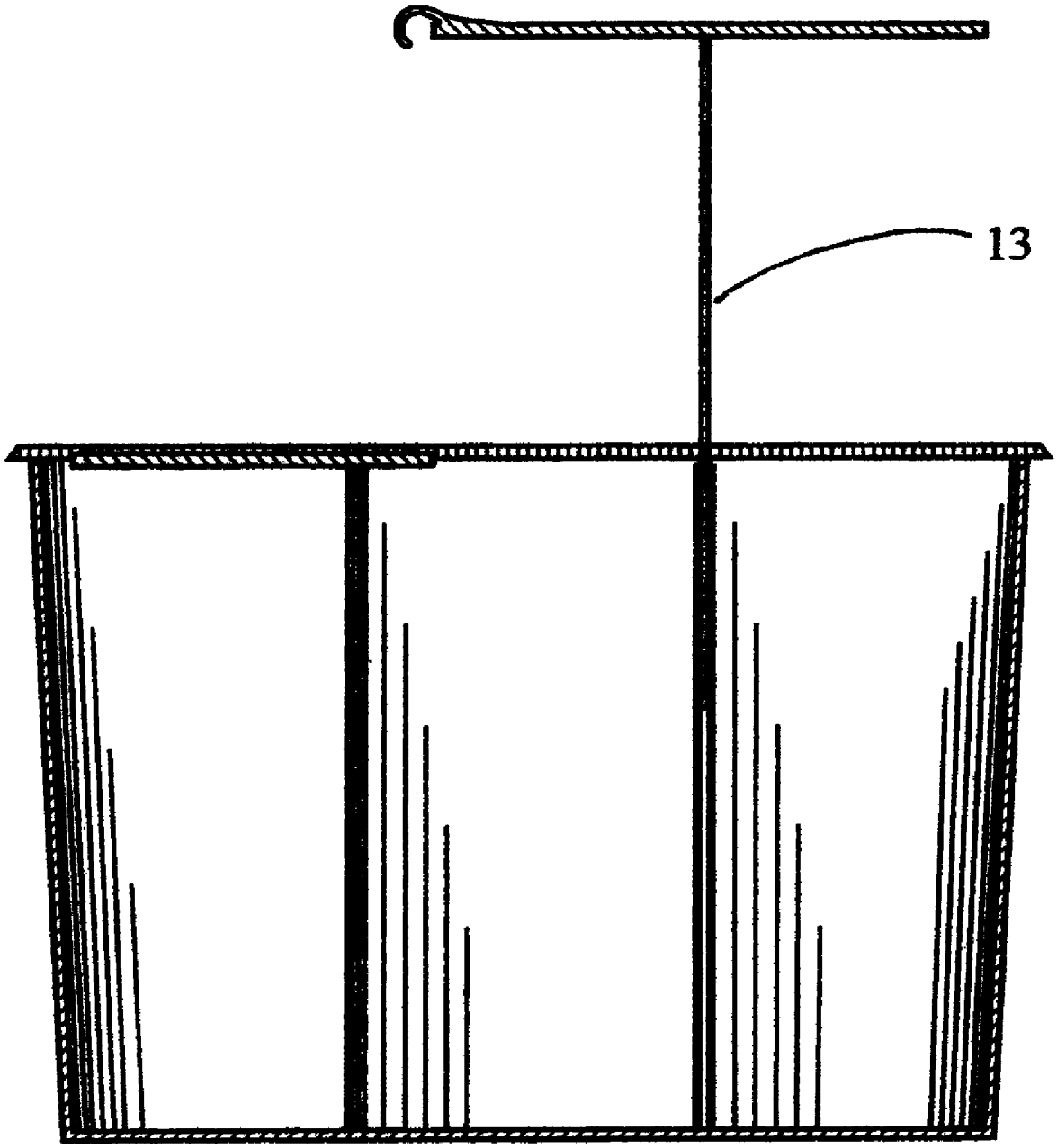
FIG. 4 is a side view of the bucket with the horizontal bar unhooked and a divider slid up.

FIG. 4 illustrates a side view of the bucket with the horizontal bars disconnected and one of the dividers 13 sliding up (the other divider remaining in the down position). The divider remaining in the down position is preferably designated the section of the bucket that a wringer will sit on top of. The hook when unhooked, permit's the user, when lifting the horizontal bars up, to lift all the verticals dividers attached to the second sections of the horizontal bars to go up, with the first sections of the horizontal bar that were disconnected and the divider attached to it remaining in its down position. The user can fill the bucket with water and the water will be able to travel through the entire bucket accept for the one section where the divider is down. This section in the bucket that has no liquid is used to hold the excess water that is created when a wringer is used to squeeze out the excess water that is created when the mop is submerged in the bucket of water. The wringer sits on top of the bucket over the section that has no liquid.

Figure 5:
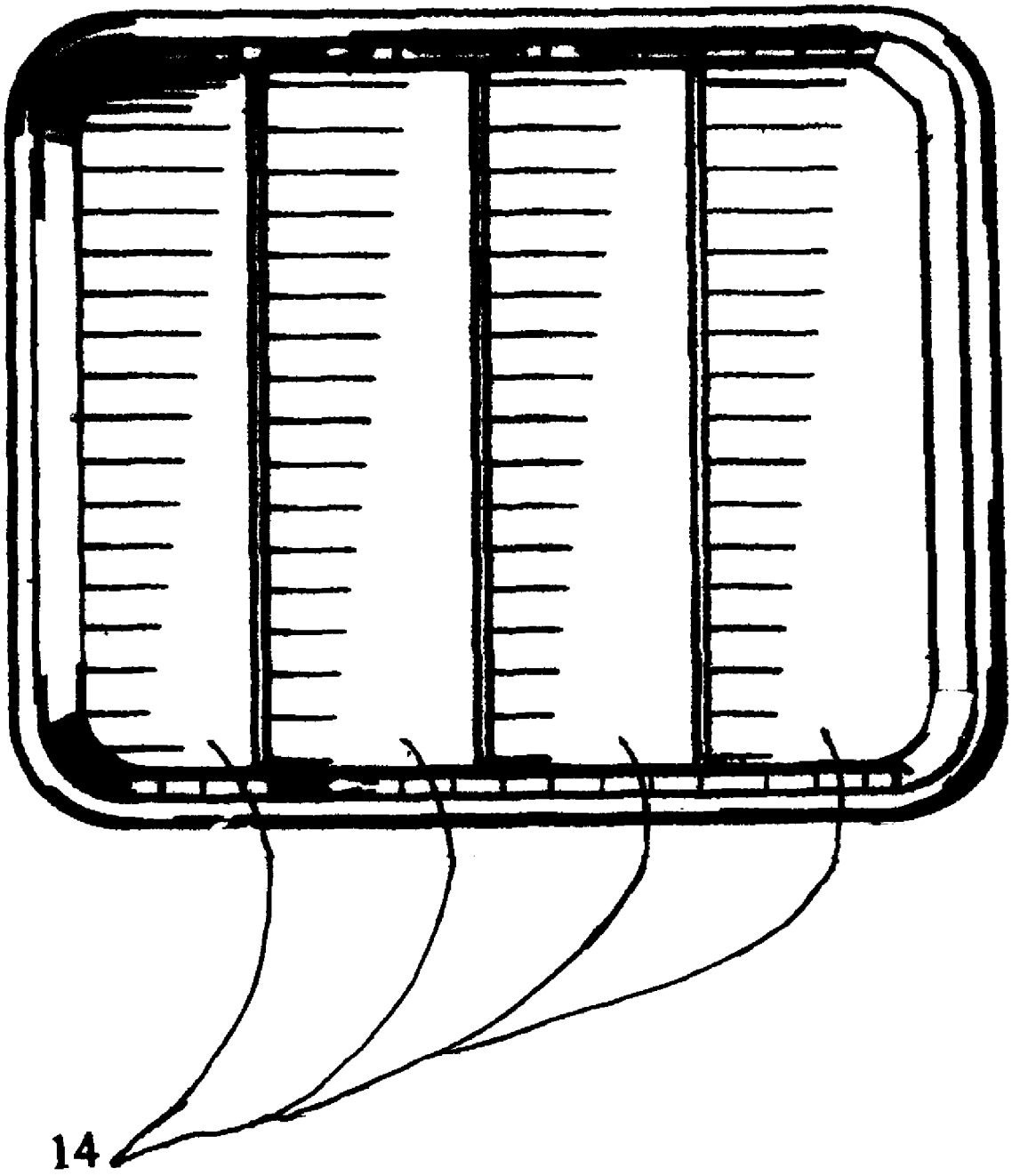
FIG. 5 is a top view of a bucket with four sections.

FIG. 5 illustrates a top view of the bucket with four sections 14. However, the invention is not considered limited to any specific number of section. For certain bucket requirements, it is expected that the number of sections may even reach ten or twelve and even higher. Thus, all number of sections (from three and up) are considered within the scope of the invention.

Figure 6:
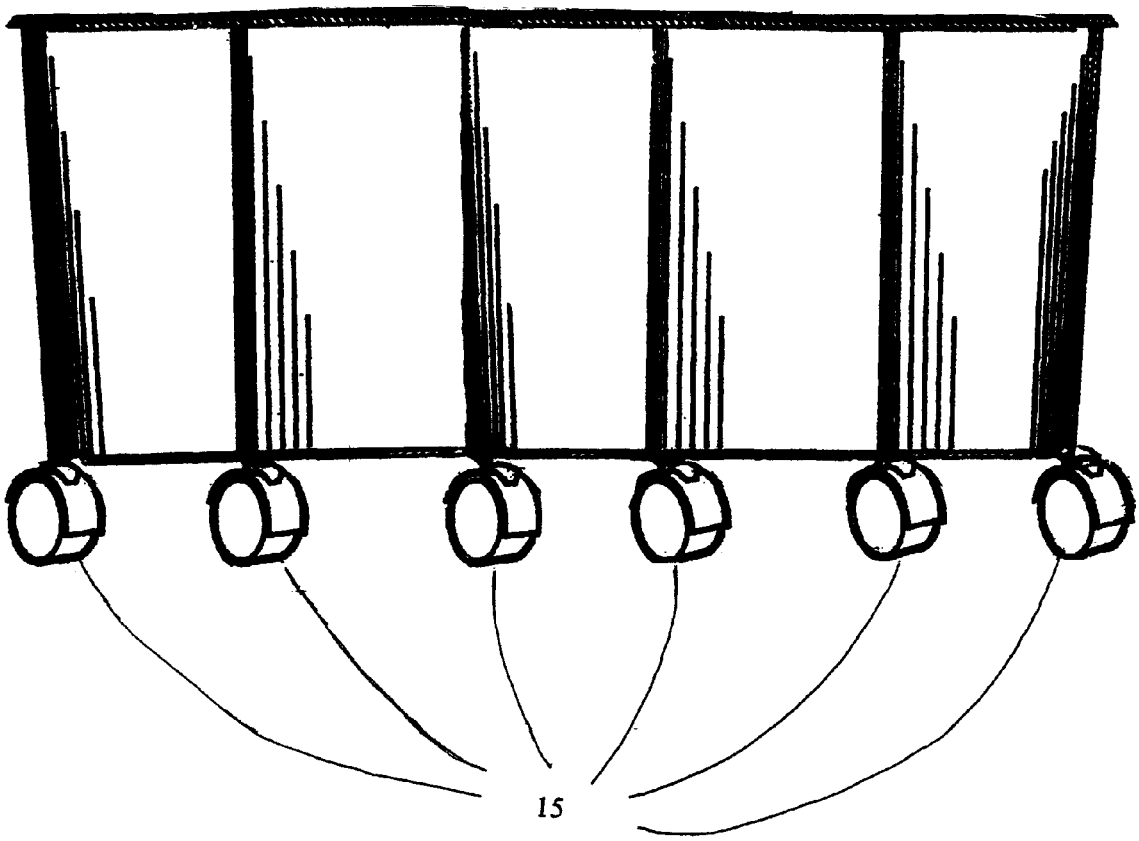
FIG. 6 is a side view of a multi sectional bucket showing six wheels in this drawing.

FIG. 6 illustrates is a side view of a multi sectional bucket showing six wheels 15. As the number of sections in the bucket increases more wheels may be needed and added. However, the invention is not considered limited to any specific number of wheels and it is also not necessarily required that wheels be secured to the bucket at each divider point.

Where a snug fit is provided between the dividers and their corresponding grooves or tracks, in addition to the seal create, such snug fit maintains the dividers in their raised position without assistance from the user, such that the user's hand can be free for other task such as pouring the clean water into the undivided sections.

Though not required or limiting, the horizontal lift bars can be provided with one or more handles for easier gripping when pulling upwards.

Thus, summarizing, a bucket is provided having three or more separate sections for separating wash liquid, such as water. The dividers in the bucket that create the various sections slide up and down on tracks. The dividers slide up so that when filling the bucket with a liquid, such as water, in one section the water will flow throughout the entire bucket. The dividers can then slide down and create isolated sealed sections of clean liquid. The dividers will slide on tracks, or guiding mechanisms, grooves, etc. and have a tight seal to prevent liquid from seeping into other sections in the bucket. The vertical dividers, or partitions, that create the various sections in the bucket can be connected to each other by means of horizontal bars attached on the top of the dividers which run along the sides of the bucket along the inside. Thus, lifting the horizontal bars up will lift all of the attached dividers simultaneously. A disconnect or release feature can be provided on the horizontal bars so that when the horizontal bar is disconnected to the remaining part of the horizontal bar, when one lifts the horizontal bars up, all of the dividers attached to the lifted bar will lift up simultaneously, while the horizontal bar that is detached (and its attached divider) will remain in its down position. This allows the user to fill the bucket with water but with the one divider remaining down one section will not get any water. This empty section is suitable for certain mop types, such as the ones that require a wringer. Wringer mops need a section to hold the large amount of excess water created when one uses the wringer device.

Though shown as preferably square or rectangular in shape, it should be recognized that the body member of the bucket can be provided in many different shapes and all are considered within the scope of the invention. Additionally, the dividers or partitions may also come in different sizes and/or shapes, which may also cause the various sections of the bucket to have different sizes and/or shapes.

Though not limited to any specific size or shape, the bucket can be preferably the size of conventional residential and/or commercial cleaning buckets and constructed from conventional cleaning bucket materials.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the invention, and rights to such alternatives are particularly reserved and considered within the scope of the invention.

What I claim is:

1. A cleaning bucket for handling liquids, said bucket comprising:

a body member having a sidewall and bottom portion to define a liquid storage area;

at least two dividers disposed within said liquid storage area to divide said liquid storage area into three or more separate sections isolated from each other in order to separate and not mix any liquids contained within said three or more sections; and a first divider lift and a second divider lift, said first divider lift having a first section and a second section and said second divider lift having a first section and a second section, wherein each of said at least two dividers having a first end and a second end, said first section of said first divider lift secured to a first one of said at least two dividers at the first end of said first one divider and said first section of said second divider lift secured to the second end of said first one divider, said second section of said first divider lift secured to said at least two dividers except for said first one divider at the first ends of said at least two dividers and said second section of said second divider lift secured to said at least two dividers except for said first one divider at the second ends of said at least two dividers; wherein pulling up on said second section of said first divider lift and said second section of said second divider lift causes said at least two dividers to be lifted up simultaneously except for said first one divider which remains in a down position.

2. The cleaning bucket of claim 1 wherein said at least two dividers are removable.

3. The cleaning bucket of claim 1 wherein said sidewall extending around a perimeter of said bottom member, wherein an internal portion of said sidewall provided with a plurality of pairs of tracks or grooves wherein each of said plurality of pairs of tracks or grooves removably receiving a corresponding one of said at least two dividers.

4. The cleaning bucket of claim 3 wherein said at least two dividers slide up and down within their corresponding pair of tracks or grooves.

5. The cleaning bucket of claim 1 wherein said first section and said second section of said first divider lift are releasably connected to each other and said first section and said second section of said second divider lift are releasably connected to each other.

6. The cleaning bucket of claim 5 wherein said first section and said second section of said first divider lift are releasably connected by a first hook type connector and said first section and said second section of said second divider lift are releasably connected by a second hook type connector.

7. The cleaning bucket of claim 1 wherein each of said three or more sections are fluidly sealed from each other so as to prevent fluids or liquids stored in one or more of the sections from becoming mixed.

8. A cleaning bucket for handling liquids, said bucket comprising:

a body member having a sidewall and bottom portion, said sidewall extending around a perimeter of the bottom portion to define a liquid storage area;

at least two removable dividers disposed within said liquid storage area to divide said liquid storage area into three or more separate sections isolated from each other in order to separate and not mix any liquids contained within said three or more sections; and a first divider lift and a second divider lift, said first divider lift having a first section and a second section and said second divider lift having a first section and a second section, wherein each of said at least two dividers having a first end and a second end, said first section of said first divider lift secured to a first one of said at least two dividers at the first end of said first one divider and said first section of said second divider lift secured to the second end of said first one divider, said second section of said first divider lift secured to said at least two dividers except for said first one divider at the first ends of said at least two dividers and said second section of said second divider lift secured to said at least two dividers except for said first one divider at the second ends of said at least two dividers; wherein pulling up on said second section of said first divider lift and said second section of said second divider lift causes said at least two dividers to be lifted up simultaneously except for said first one divider which remains in a down position.

9. The cleaning bucket of claim 8 wherein said first section and said second section of said first divider lift are releasably connected to each other and said first section and said second section of said second divider lift are releasably connected to each other.

10. The cleaning bucket of claim 8 further comprising a plurality of wheels secured to the bottom portion of said body member.

11. The cleaning bucket of claim 9 wherein said first section and said second section of said first divider lift are releasably connected by a first hook type connector and said first section and said second section of said second divider lift are releasably connected by a second hook type connector.

12. The cleaning bucket of claim 8 wherein each of said three or more sections are fluidly sealed from each other so as to prevent fluids or liquids stored in one or more of the sections from becoming mixed.

13. The cleaning bucket of claim 8 wherein said first divider lift and said second divider lift are substantially perpendicular with respect to said at least two removable dividers at all times.

14. A cleaning bucket for handling liquids, said bucket comprising:

a body member having a sidewall and bottom portion to define a liquid storage area; and at least two dividers disposed within said liquid storage area to divide said liquid storage area into three or more separate sections isolated from each other in order to separate and not mix any liquids contained within said three or more sections;

wherein each divider of the at least two dividers independent of all remaining dividers of the at least two dividers such that none of dividers of the at least two dividers come into direct contact with any other divider of the at least two dividers;

wherein all dividers of said at least two dividers are positioned substantially parallel with respect to each other when disposed within said liquid storage area.

15. The cleaning bucket of claim 14 further comprising a plurality of wheels secured to the bottom portion of said body member.

16. The cleaning bucket of claim 14 wherein said body member is substantially square or rectangular in shape.

17. The cleaning bucket of claim 14 wherein said first divider lift and said second divider lift are substantially perpendicular with respect to said at least two dividers at all times.

* * * * *